US010471461B2

(12) United States Patent
Ganzer

(10) Patent No.: US 10,471,461 B2
(45) Date of Patent: Nov. 12, 2019

(54) LIQUID DISPENSING MODULE

(71) Applicant: NORDSON CORPORATION, Westlake, OH (US)

(72) Inventor: Charles P. Ganzer, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 15/902,985

(22) Filed: Feb. 22, 2018

(65) Prior Publication Data

US 2018/0250702 A1 Sep. 6, 2018

Related U.S. Application Data

(60) Provisional application No. 62/465,657, filed on Mar. 1, 2017.

(51) Int. Cl.

| | |
|---|---|
| ***B05C 11/10*** | (2006.01) |
| ***B05C 17/015*** | (2006.01) |
| ***B05C 5/02*** | (2006.01) |

(52) U.S. Cl.

CPC ..... *B05C 11/1034* (2013.01); *B05C 5/0225* (2013.01); *B05C 5/0237* (2013.01); *B05C 17/015* (2013.01); *B05C 11/1028* (2013.01); *B05C 11/1042* (2013.01)

(58) Field of Classification Search

CPC .. B05C 11/1034; B05C 5/0225; B05C 17/015
USPC .... 22/146.5, 190, 325, 504, 559; 222/146.5, 222/190, 325, 504, 559
See application file for complete search history.

(56) References Cited

U.S. PATENT DOCUMENTS

| | | | | |
|---|---|---|---|---|
| 3,412,971 A | | 11/1968 | McDivitt | |
| 3,840,158 A | * | 10/1974 | Baker | B05C 5/0237 222/487 |
| 4,360,132 A | * | 11/1982 | Vilagi | B05B 9/01 222/504 |
| 4,711,379 A | * | 12/1987 | Price | B05C 5/001 137/625.64 |

(Continued)

FOREIGN PATENT DOCUMENTS

| | | |
|---|---|---|
| DE | 19914343 A1 | 10/2000 |
| WO | 2008/059909 A1 | 5/2008 |

OTHER PUBLICATIONS

ISA/220—Notification of Transmittal or Search Report and Written Opinion of the ISA, or the Declaration dated May 7, 2018 for WO Application No. PCT/US18/019370.

*Primary Examiner* — Vishal Pancholi
(74) *Attorney, Agent, or Firm* — Baker & Hostetler LLP

(57) ABSTRACT

A dispensing module includes a needle and an actuator housing defining an actuator cavity with an actuator disposed therein, a body cavity, and a needle passageway connecting the actuator cavity and the body cavity. A lower end of the needle defines a valve element, and an upper end of the needle is secured to the actuator. The dispensing module also includes a nozzle adapter releasably coupled to the actuator housing, where the nozzle adapter defines a seal seat, a fluid inlet, a fluid channel, and a fluid outlet in fluid communication with the fluid inlet and the fluid channel. The nozzle adapter is configured to be releasably coupled to the actuator housing using one or more fasteners, such that the needle extends into the fluid channel.

28 Claims, 6 Drawing Sheets

(56) References Cited

U.S. PATENT DOCUMENTS

| | | | | | |
|---|---|---|---|---|---|
| 5,207,352 | A * | 5/1993 | Porter | B05B 12/087 | 222/1 |
| 5,535,919 | A * | 7/1996 | Ganzer | B05C 5/001 | 222/1 |
| 5,934,520 | A * | 8/1999 | Byerly | B05C 5/0225 | 222/325 |
| 6,253,957 | B1 * | 7/2001 | Messerly | B05C 5/001 | 222/1 |
| 7,296,714 | B2 * | 11/2007 | Byerly | B05C 5/0225 | 222/146.5 |
| 7,900,800 | B2 * | 3/2011 | Hassler, Jr. | B05C 5/001 | 222/146.5 |
| 8,333,307 | B2 * | 12/2012 | Chastine | B05C 5/0237 | 222/542 |
| 2004/0074994 | A1 * | 4/2004 | Ganzer | B05C 5/0225 | 239/533.1 |
| 2016/0325294 | A1 | 11/2016 | Macindoe | | |

* cited by examiner

LIQUID DISPENSING MODULE

CROSS REFERENCE TO RELATED APPLICATIONS

This application claims the benefit of U.S. Provisional Patent App. No. 62/465,657, filed Mar. 1, 2017, the disclosure of which is hereby incorporated by reference herein.

TECHNICAL FIELD

This disclosure generally relates to liquid dispensing devices and, more particularly, to liquid dispensing devices for dispensing viscous liquids, such as hot melt adhesives.

BACKGROUND

A typical dispensing device for supplying a liquid, such as a hot melt adhesive, generally includes a body including a needle having a valve element that blocks and unblocks a fluid outlet. The needle is actuated by an actuator in a first cavity of the body. In pressure-type dispensers, when the fluid outlet is unblocked, the pressured liquid is dispensed as a continuous stream of liquid. In jetting-type dispensers, the striking of the needle against the fluid outlet causes discrete amounts of pressurized liquid to be dispensed.

Dispensing devices further include a fluid channel that directs liquid from a fluid inlet to a fluid outlet. The fluid channel can be located within a second cavity of the body of the dispensing device. The first and second cavities can be connected by a passageway that allows the needle to extend from the first cavity into the second cavity. Because the first and second cavities are open to each other via the passageway, a seal is typically placed within the body of the dispensing device to prevent fluid flow from the second cavity into the first cavity. Inadequate sealing will allow fluid to flow into the first cavity and come into contact with the actuator, which can severely inhibit or disable the actuator.

The operation of dispensing devices with hot melt adhesives can be challenging due to the way certain hot melt adhesives cure. Examples of catalysts to the curing of hot melt adhesives are moisture and heat. Once certain hot melt adhesives are cured, such as polyurethane (PUR) adhesive, they cannot be melted again, as the internal structure of the adhesive has changed. Also, some adhesives can be very difficult to clean using solvents.

During operation of the dispensing device, hot melt adhesive can build up within the fluid flow path and impede the flow of additional liquid. As a result, the dispensing device must be periodically disassembled and a flush material must be passed through the flow path to remove any material remaining within the flow path. The flush material is preferably a compatible material having a similar viscosity as the hot melt adhesive. The amount of material build-up within the flow path is partially determined by the geometric complexity of the flow path, including the presence of any recesses, angled surfaces, threading, etc. Any increase in the amount of material build-up within the flow path increases both the time required to clean the dispensing device and the difficulty of completely flushing liquid from the dispensing device.

Further, a complex flow path can result in flush material remaining within the flow path after cleaning has been completed. Any flush material that remains in the fluid flow path following flushing can compromise the purity of any liquid that subsequently passes through the dispensing device. Decreasing the complexity of the fluid channel and the potential for material build-up within the fluid channel can limit the amount of time a dispensing device is out of operation for cleaning, as well as increase the efficiency and completeness with which flushing takes place, and increase the accuracy with which a user can verify that all flush material has been removed from the fluid channel.

Therefore, there is a need for an improved dispensing device that can be cleaned and/or replaced more easily and effectively.

SUMMARY

An embodiment of the present disclosure includes a dispensing module for dispensing a liquid. The dispensing module includes an actuator housing defining an actuator cavity, a body cavity, and a needle passageway connecting the actuator cavity and the body cavity. The dispensing module further includes an actuator disposed within the actuator cavity, and a needle defining an upper end and a lower end opposite the upper end in a longitudinal direction. The lower end of the needle defines a valve element, and the upper end of the needle is secured to the actuator such that the needle extends from the actuator cavity through the needle passageway. Further, the dispensing module includes a nozzle adapter releasably coupled to the actuator housing, the nozzle adapter defining a seal seat, a fluid inlet, a fluid channel partially defined by a valve seat, and a fluid outlet in fluid communication with the fluid inlet and the fluid channel. The fluid channel extends from the seal seat to the fluid outlet. The nozzle adapter is configured to be at least partially disposed within the body cavity when coupled to the actuator housing, such that the lower end of the needle extends into the fluid channel. Additionally, the dispensing module includes at least one seal configured to be received within the seal seat, where the at least one seal is configured to prevent flow of the liquid from the fluid channel of the nozzle adapter into the needle passageway of the actuator housing.

Another embodiment of the dispensing module includes an actuator housing defining a top surface and a bottom surface opposite the top surface in a longitudinal direction, where the bottom surface defines a first aperture configured to receive a fastener. The actuator housing further defines an actuator cavity, a body cavity, and a needle passageway connecting the actuator cavity and the body cavity. The dispensing module further includes an actuator disposed within the actuator cavity, and a needle defining an upper end and a lower end opposite the upper end in the longitudinal direction. The lower end of the needle defines a valve element, and the upper end of the needle is secured to the actuator such that the needle extends from the actuator cavity through the needle passageway. The dispensing module further includes a nozzle adapter defining a nozzle body that includes an upper surface, a lower surface opposite the upper surface in the longitudinal direction, and a protrusion extending from the nozzle body in a lateral direction that is perpendicular to the longitudinal direction at a location between the upper surface and the lower surface along the longitudinal direction. The protrusion defines a second aperture configured to receive the fastener. The nozzle adapter further defines a seal seat, a fluid inlet, a fluid outlet, and a fluid channel extending from the seal seat to the fluid outlet, wherein the fluid channel is in fluid communication with the fluid inlet and the fluid outlet. The fluid channel is partially defined by a valve seat. The nozzle adapter is configured to be at least partially disposed within the nozzle body cavity when coupled to the actuator housing, such that the lower end of the needle extends into the fluid channel, and the fastener extends through the first aperture and the second aperture, such that the fastener releasably secures the nozzle adapter to the actuator housing.

BRIEF DESCRIPTION OF THE DRAWINGS

The foregoing summary, as well as the following detailed description, will be better understood when read in conjunction with the appended drawings. The drawings show illustrative embodiments of the disclosure. It should be understood, however, that the application is not limited to the precise arrangements and instrumentalities shown.

DETAILED DESCRIPTION OF ILLUSTRATIVE EMBODIMENTS

Figure 2:
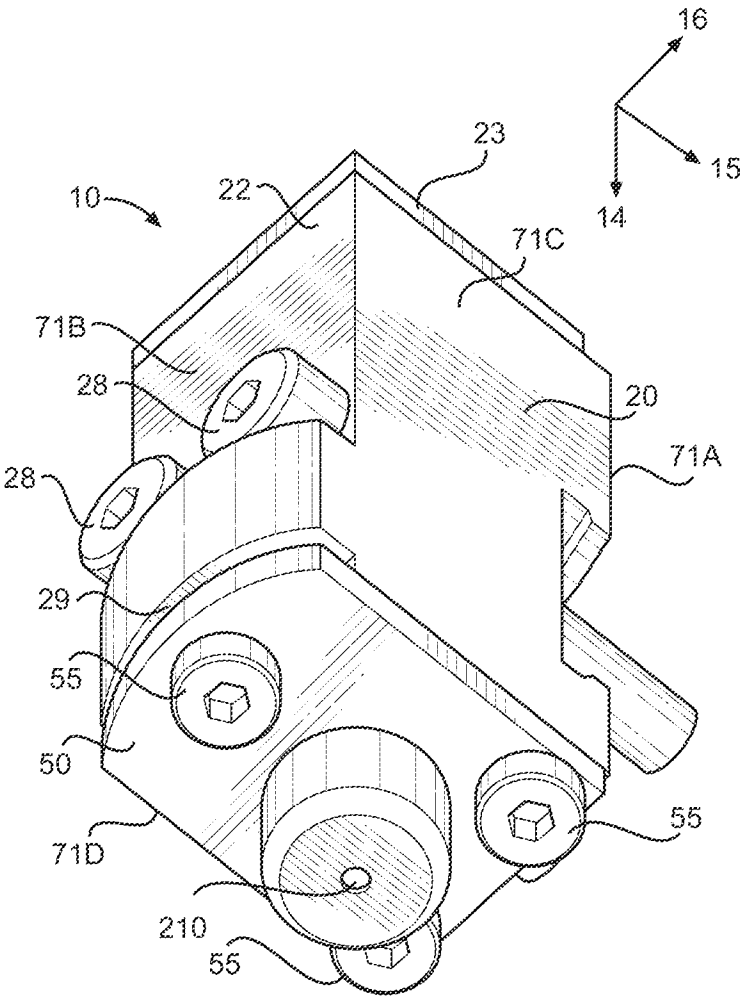
FIG. 2 is an alternative perspective view of the dispensing module illustrated in FIG. 1.

Described herein is a dispensing module 10 that includes an actuator housing 20 and a nozzle adapter 50, where the nozzle adapter 50 is releasably coupled to the actuator housing 20. The nozzle adapter 50 may be releasably coupled to the actuator housing 20 using fasteners 55, such that when the fasteners 55 are removed from the dispensing module 10, the nozzle adapter 50 can be separated from the actuator housing 20. Also, the nozzle adapter 50 may define a fluid channel 250 that defines a simple flow path and does not contain any seals therein, and as such is easily cleaned.

Certain terminology is used to describe the dispensing module 10 in the following description for convenience only and is not limiting. The words "right", "left", "lower" and "upper" designate directions in the drawings to which reference is made. The words "inner" and "outer" refer to directions toward and away from, respectively, the geometric center of the description to describe dispensing module 10 and related parts thereof. The terminology includes the above-listed words, derivatives thereof and words of similar import.

The dispensing module 10 is described herein as extending vertically along a longitudinal direction 14, and horizontally along a lateral direction 15 and a transverse direction 16. Unless otherwise specified herein, the terms "longitudinal," "transverse," and "lateral" are used to describe the orthogonal directional components of various components of dispensing module 10. It should be appreciated that while the transverse and lateral directions are illustrated as extending along a horizontal plane, and that the longitudinal direction is illustrated as extending along a vertical plane, the planes that encompass the various directions may differ during use.

Figure 1:
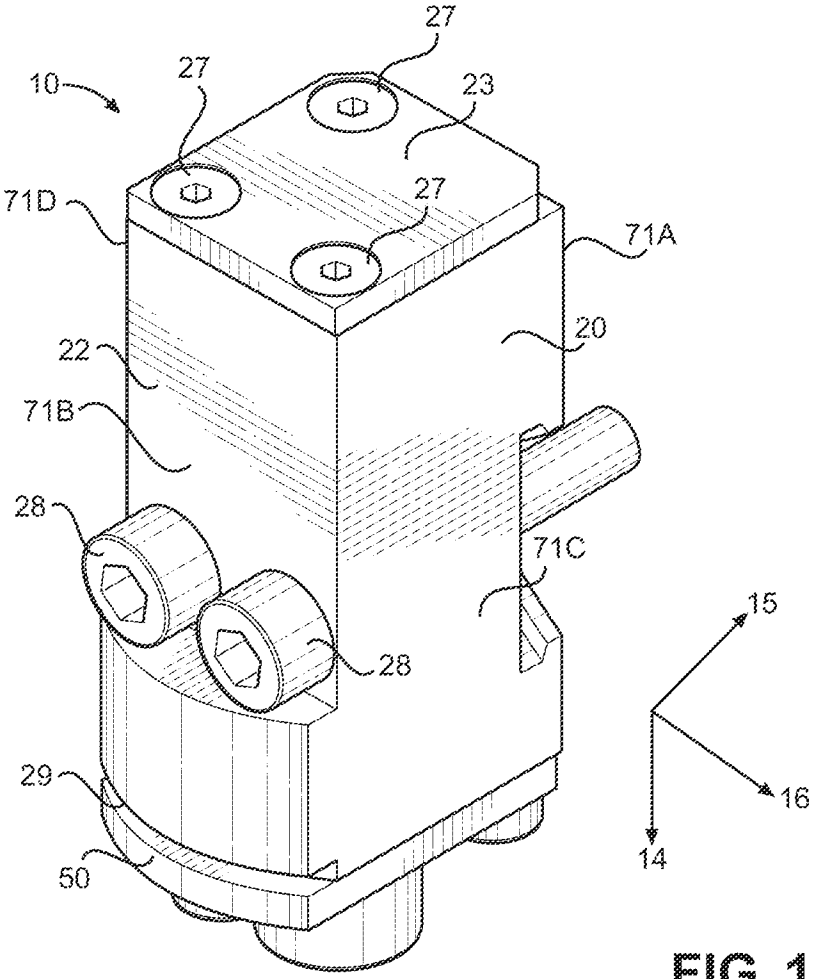
FIG. 1 is a perspective view of a dispensing module according to an embodiment of the present disclosure.

Referring to FIG. 1, an upper perspective view of an embodiment of the dispensing module 10 of the present disclosure is illustrated. The dispensing module 10 includes a housing cap 23, an actuator housing 20, and a nozzle adapter 50, the nozzle adapter 50 being the portion of dispensing module 10 from which a hot melt adhesive or other liquid is dispensed. The dispensing module 10 may be disposed below housing cap 23 along the longitudinal direction 14. The dispensing module 10 includes fasteners 28 for releasably attaching the dispensing module to a gun manifold or other body (not shown). Fasteners 28 extend through apertures 160 defined by the actuator housing 20. Also included are fasteners 27 for releasably securing the housing cap 23 to the actuator housing 20. The actuator housing 20 includes a body 22 that may define a slot 29 adjacent to the nozzle adapter 50. The slot 29 can be used as a pry point when separating the actuator housing 20 from the nozzle adapter 50, such that an operator of the dispensing module 10 can insert a tool (not shown) into the slot 29 and use the tool as a lever to separate the actuator housing 20 from the nozzle adapter 50. FIG. 2 provides an alternative lower perspective view of the dispensing module 10. As shown in FIG. 2, the nozzle adapter 50 includes a fluid outlet 210, through which hot melt adhesive or other liquid exits the dispensing module 10. The dispensing module 10 also includes fasteners 55, which releasably secure the nozzle adapter 50 to the actuator housing 20.

Figure 3:
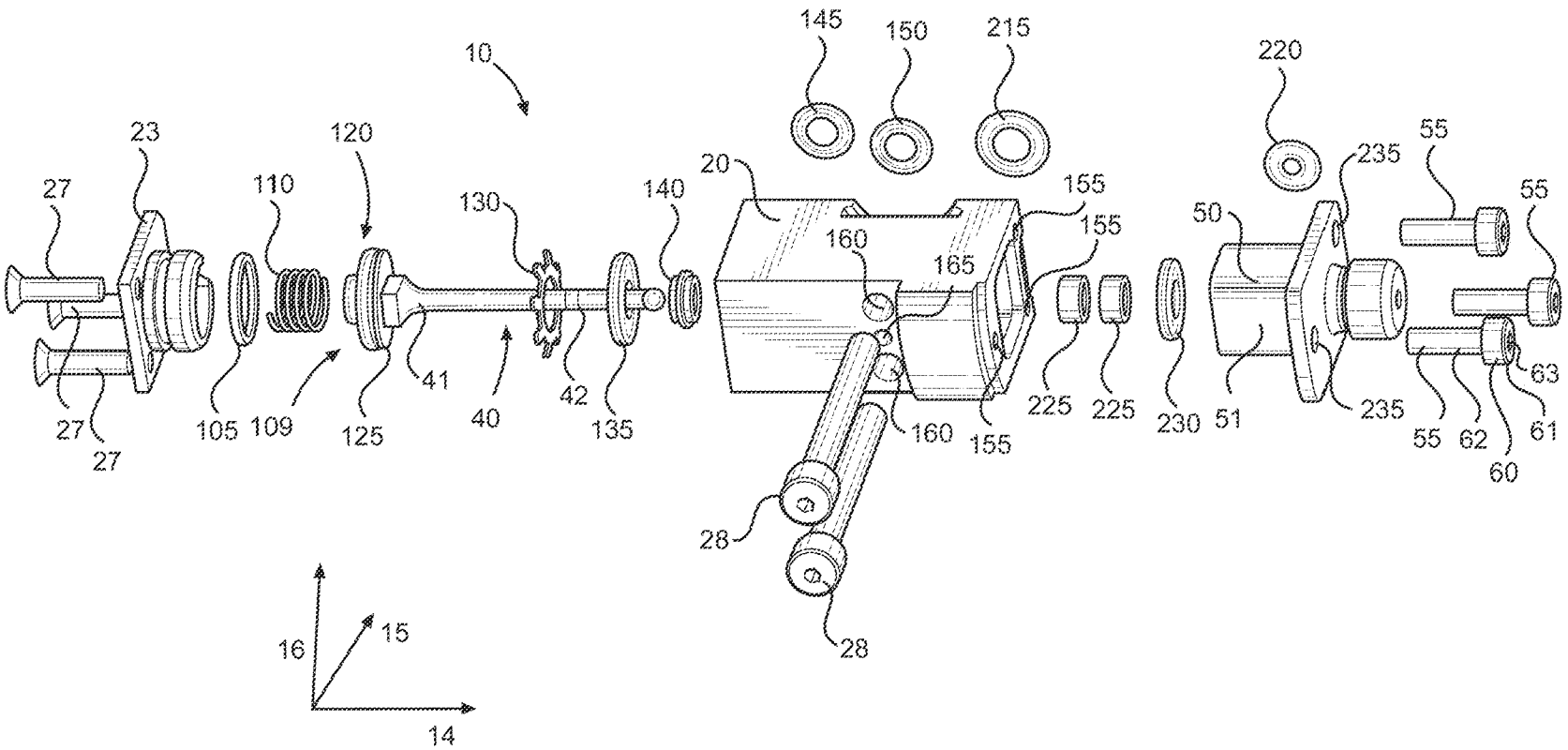
FIG. 3 is an exploded perspective view of the dispensing module illustrated in FIG. 1.
Figure 4:
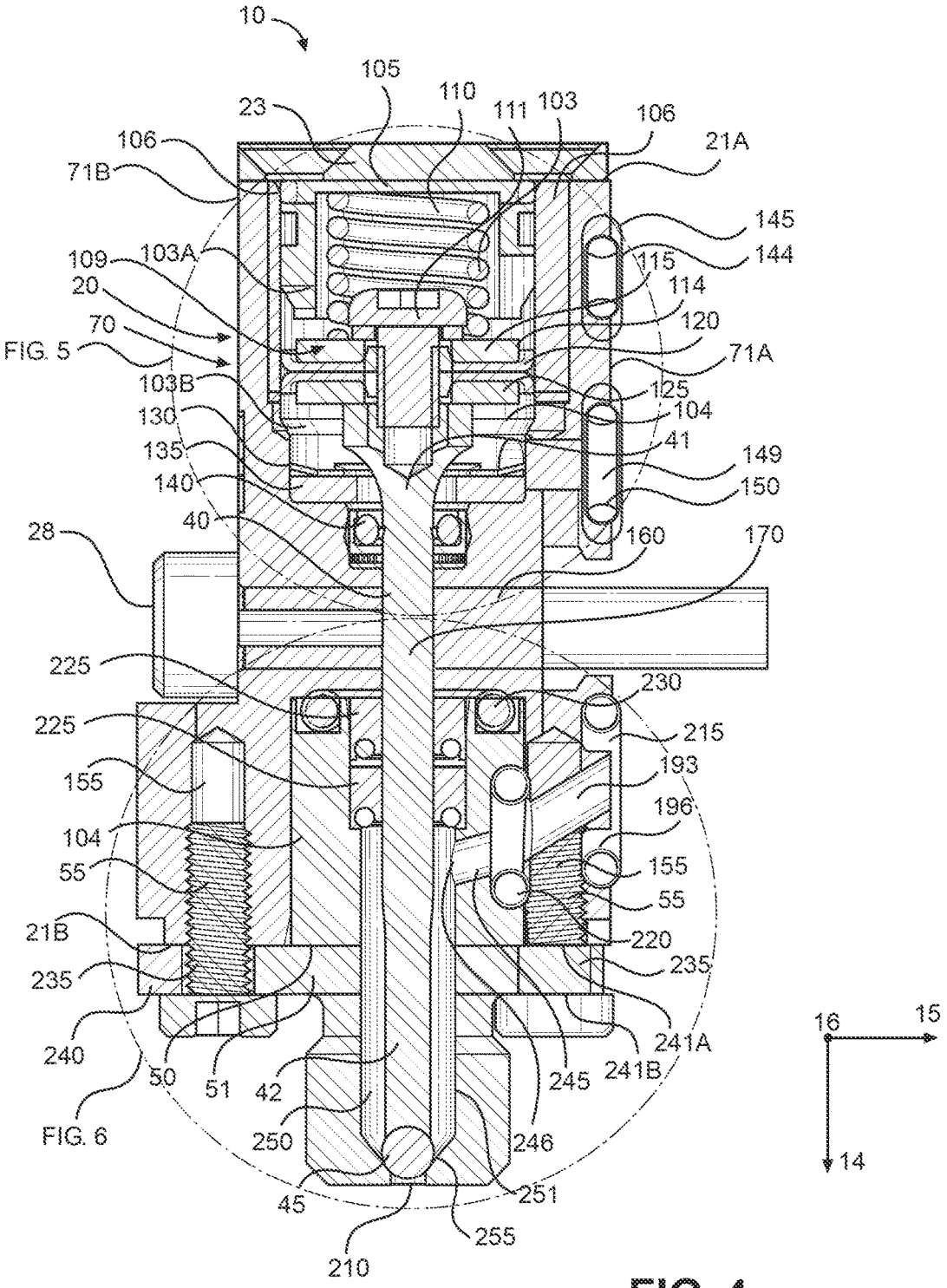
FIG. 4 is an elevation view of the dispensing module illustrated in FIG. 1, in longitudinal cross-section.
Figure 5:
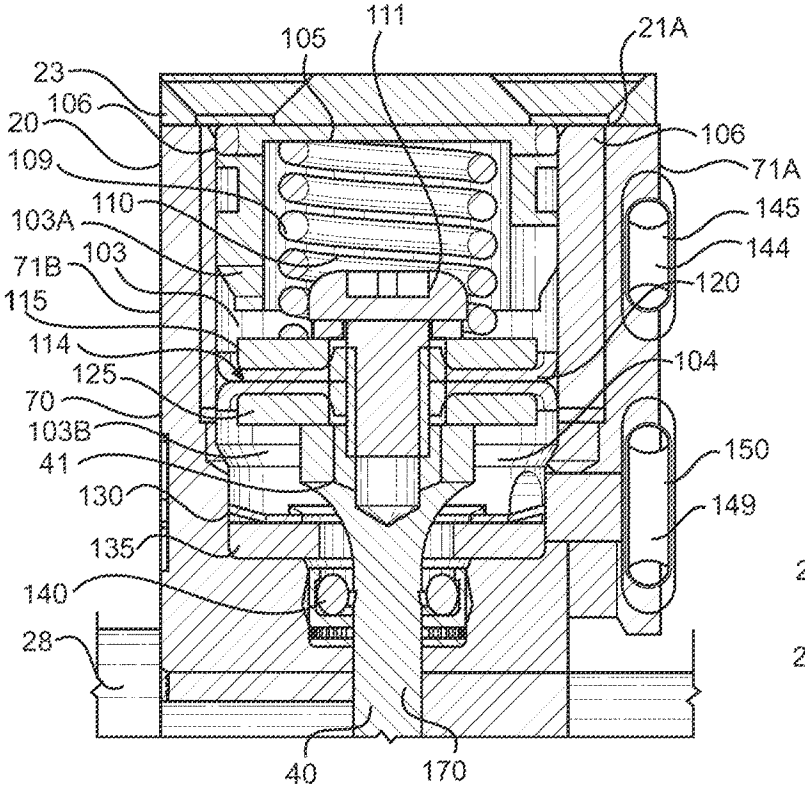
FIG. 5 is a longitudinal cross section of an upper section of the dispensing module of FIG. 4, noted by the upper encircled region of FIG. 4.

Referring next to FIGS. 3-5, the actuator housing 20 defines an actuator housing top surface 21*a*, an actuator housing bottom surface 21*b* opposite the actuator housing top surface 21*a* along the longitudinal direction 14, and an outer surface 70. The outer surface 70 of the actuator housing 20 includes a first lateral outer surface 71*a*, a second lateral outer surface 71*b* opposite the first lateral outer surface 71*a* along the lateral direction 15, a first transverse outer surface 71*c*, and a second transverse outer surface 71*d* opposite the first transverse outer surface 71*c* along the transverse direction 16. The actuator housing 20 further defines an actuator cavity 103. The actuator cavity 103 is located between first lateral outer surface 71*a* and second lateral outer surface 71*b*, as well as between the first transverse outer surface 71*c* and the second transverse outer surface 71*d*. The actuator cavity 103 may be partially defined by the housing cap 23. The dispensing module 10 further includes a needle 40, which defines an upper end 41 and a lower end 42 opposite the upper end 41 in the longitudinal direction 14. The upper end 41 of the needle 40 is disposed within the actuator cavity 103. The actuator housing 20 also defines a needle passageway 170 extending from the actuator cavity 103 in the longitudinal direction 14. The needle passageway 170 receives a portion of the needle 40 that is disposed outside of the actuator cavity 103. Also disposed within the actuator cavity 103 is an actuator 109 operatively coupled to the needle 40. The actuator 109 may be a pneumatic actuator that is in communication with a pressurized air source (not shown). The actuator 109 may include a piston assembly 114 coupled to the upper end 41 of the needle 40. The piston assembly 114 may divide the actuator cavity 103 into an upper portion 103*a* and a lower portion 103*b*. The piston assembly 114 may include a piston seal 120 positioned between a lower piston element 125 and an upper piston element 115. A piston fastener 111 may extend through the piston assembly 114, such that the piston fastener 111 extends through the upper piston element 115, the piston seal 120, and the lower piston element 125. The piston seal 120 may serve to prevent pressurized air from escaping the lower portion 103*b* of actuator cavity 103 into the upper portion 103*a*. The piston fastener 111 may function to secure the piston assembly 114 to the upper end 41 of the needle 40. However, alternative means for securing the piston assembly 114 to the needle 40 are contemplated, such as, for example, a crimping ring.

The lower portion 103*b* of actuator cavity 103 may define a pressurized air chamber 104, as illustrated in FIGS. 4 and 5. The lower end of the lower portion 103*b* of the actuator cavity 103 may be configured to receive a seal 140 disposed around the needle 40. The seal 140 may be a pneumatic seal that prevents pressurized air from leaking out of the lower portion 103*b* of actuator cavity 103 into the needle passageway 170. The lower portion 103*b* of the actuator cavity 103 may also include a retaining washer 135 for securing the seal 140 in place and a ring 130 disposed adjacent to the retaining washer 135 that is configured to prevent the retaining washer 135 and seal 140 from moving upwards within the actuator cavity 103. Upward movement of the retaining washer 135 and seal 140 within the actuator cavity 103 could possibly allow pressurized air to escape the actuator cavity 103. The dispensing module 10 may include an air inlet 149 that extends from the first lateral outer surface 71*a* to the lower portion 103*b* of the actuator cavity 103. However, the air inlet 149 may extend to the lower portion 103*b* of the actuator cavity 103 from any location along the outer surface 70 of the actuator housing 20 as desired. An air inlet seal 150 may be disposed along the first lateral outer surface 71*a* at the opening of the air inlet 149 to prevent pressurized air from leaking out of the lower portion 103*b* of the actuator cavity 103. When the lower portion 103*b* of the actuator cavity 103 is pressurized with air from the air inlet 149, the pressurized air exerts a force on the lower piston element 125. This force causes the piston assembly 114 and the needle 40 to move upward relative to the neutral position of the needle 40 when no force is exerted on the piston assembly 114.

The housing cap 23 may contact the actuator housing top surface 21*a*, and may define a portion of actuator cavity 103, particularly the upper portion 103*a*. As noted previously, the housing cap 23 may be coupled to the actuator housing 20 via fasteners 27. A seal 105, such as an O-ring, may be disposed between the housing cap 23 and the actuator housing 20 in order to prevent pressurized air from escaping the upper portion 103*a* of the actuator cavity 103. Fasteners 27, which may be threaded screws, for example, extend through the housing cap 23 and apertures 106 defined by the actuator housing 20, such that the housing cap 23 is releasably coupled to the actuator housing 20. The actuator 109 may further include a spring 110 in the upper portion 103*a* of the actuator cavity 103 that urges the needle 40 downwards to a neutral position. The spring 110 may be disposed between the piston assembly 114 and the housing cap 23, such that the spring 110 contacts both the piston assembly 114 and the housing cap 23. The spring 110 may be a compression spring. Thus, when the lower portion 103*b* of the actuator cavity 103 is depressurized, the spring may apply a downward force to the piston assembly 114 that causes the needle 40 to travel downwards. However, the spring 110 may be any other type of spring as desired. The housing cap 23 may be adjustable in relation to the actuator housing 20, such that the amount of biasing force that is provided by the spring 110 may be adjusted. Other configurations of the actuator 109 are possible, such as a double acting piston with pressurized air chambers on both sides of the piston assembly 114. For example, an actuator 109 configured as a double acting piston could include a pressurized air chamber in the upper portion 103*a* of the actuator cavity 103, as well as a pressurized air chamber 104 in the lower portion 103*b* of the actuator cavity 103. In this configuration, a second air inlet 144, which is defined by the actuator housing 20, can be utilized to provide pressurized air to the upper portion 103*a* of the actuator cavity 103. Dispensing module 10 may include a second air inlet seal 145 disposed along the first lateral outer surface 71*a* at the opening of second air inlet 144 to prevent pressurized air from leaking out of the upper portion 103*a* of the actuator cavity 103. In another embodiment, the actuator 109 may include electrical actuators that are configured to selectively move the needle 40.

Figure 6:
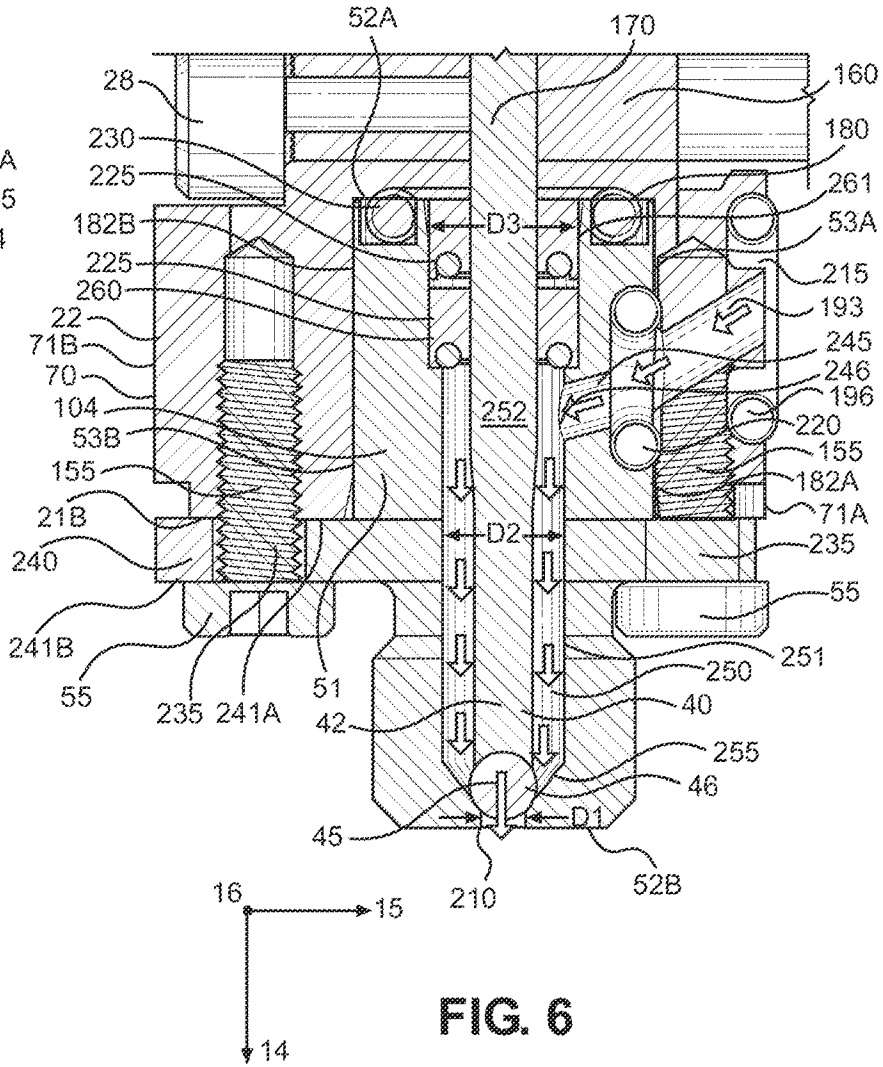
FIG. 6 is a longitudinal cross section of a lower section of the dispensing module of FIG. 4, noted by the lower encircled region of FIG. 4.

Turning now to FIGS. 4-6, the dispensing module 10 further includes a needle passageway 170, which is configured to receive a portion of the needle 40. The needle passageway 170 extends from the actuator cavity 103 to a body cavity 104, which will be described below. A weep hole 165 (shown in FIG. 3) may be defined by the actuator housing 20. The weep hole 165 may extend along the lateral direction 15 from the second lateral outer surface 71*b* of the actuator housing 20 to the needle passageway 170. However, the weep hole 165 may extend from any location on the outer surface 70 of the actuator housing 20 to the needle passageway 170, as desired. If liquid seeps into the needle passageway 170, the liquid may flow through weep hole 165 and out of the actuator housing 20. This may occur when seals disposed within the actuator housing 20 have failed or become sufficiently worn such that replacement is required. As a result, the weep hole 165 can provide a visual indication to a dispensing module operator that a seal within dispensing module 10 must be replaced, and disassembly of the dispensing module 10 is required.

Figure 7:
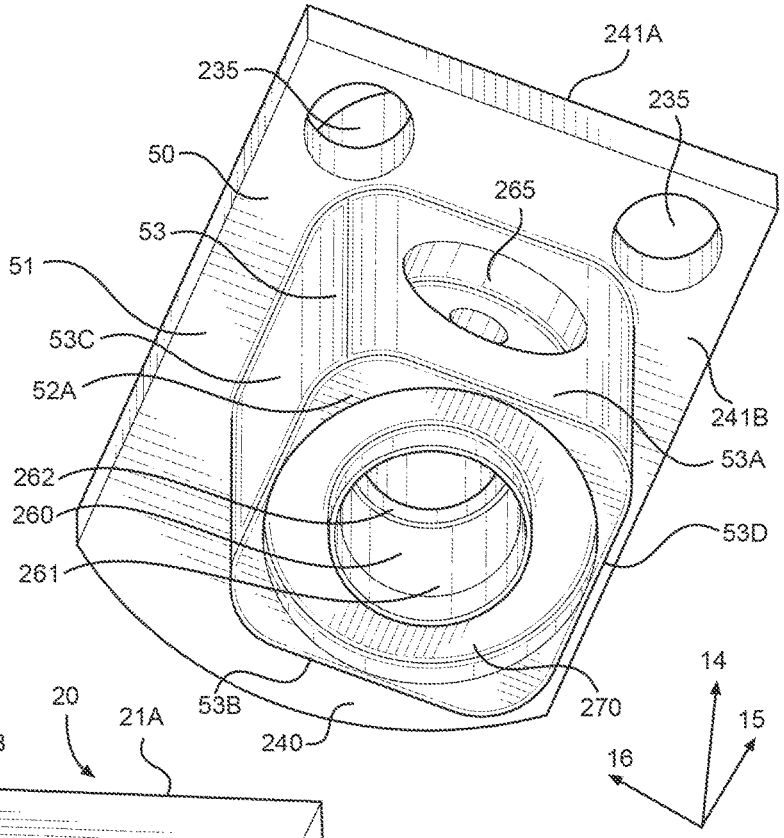
FIG. 7 is a perspective view of the nozzle adapter shown in FIGS. 1-4 and 6.

Turning to FIGS. 4 and 6-7, the nozzle adapter 50 will be described in greater detail. The nozzle adapter 50 defines a nozzle body 51 that defines an upper surface 52*a* and a lower surface 52*b* spaced from the upper surface 52*a* along the longitudinal direction 14. The nozzle adapter 50 also defines an outer sidewall surface 53. The outer sidewall surface includes a first lateral outer sidewall surface 53*a*, a second lateral outer sidewall surface 53*b* spaced from the first lateral outer sidewall surface 53*a* along the lateral direction 15, a first transverse outer sidewall surface 53*c*, and a second transverse outer sidewall surface 53*d* spaced from the first transverse outer sidewall surface 53*c* along the transverse direction 16. The outer sidewall surface 53 may be substantially smooth. In particular, the outer sidewall surface 53 may be unthreaded. Between the upper surface 52*a* and the lower surface 52*b*, the nozzle adapter 50 defines a protrusion 240 that may extend from the nozzle adapter 50 at a location between the upper surface 52*a* and the lower surface 52*b* along the lateral direction 15, the transverse direction 16, or both the lateral direction 15 and the transverse direction 16. The protrusion 240 defines a protrusion top surface 241*a*, and a protrusion bottom surface 241*b* spaced from the protrusion top surface 241*a* along the longitudinal direction 14. The protrusion 240 also includes apertures 235 that extend from the protrusion top surface 241*a* to the protrusion bottom surface 241*b*. The apertures 235 may extend substantially along the longitudinal direction 14, or may extend along any other direction as desired. The apertures 235 are configured to receive fasteners 55. The fasteners 55 are configured to releasably secure the nozzle adapter 50 to the actuator housing 20, as will be described in further detail below.

Referring to FIGS. 4 and 6-8, the actuator housing 20 will be described in further detail. The actuator housing 20 defines a body cavity 104 that is configured to receive at least a portion of the nozzle adapter 50, such that the nozzle adapter 50 is releasably coupled to the actuator housing 20. The body cavity 104 may be partially defined by a body cavity top surface 180 that is spaced between the actuator housing top surface 21*a* and the actuator housing bottom surface 21*b* along the longitudinal direction 14. The body cavity 104 may also be partially defined by a first transverse inner surface 183*a*, a second transverse inner surface 183*b* that is spaced from the first transverse inner surface 183*a* along the transverse direction 16, a first lateral inner surface 182*a*, and a second lateral inner surface 182*b* spaced from the first lateral inner surface 182*a* along the lateral direction 15. The body cavity top surface 180 may define a lower end of the needle passageway 170, which extends from the body cavity 104 to the actuator cavity 103. The first lateral inner surface 182*a*, second lateral inner surface 182*b*, first transverse inner surface 183*a*, and second transverse inner surface 183*b* may be substantially smooth. In particular, the first lateral inner surface 182*a*, second lateral inner surface 182*b*, first transverse inner surface 183*a*, and second transverse inner surface 183*b* may be unthreaded.

The nozzle adapter 50 may be configured such that when the body cavity 104 receives at least a portion of the nozzle adapter 50, the upper surface 52*a* of the nozzle adapter 50 contacts the body cavity top surface 180. Also, the first lateral outer sidewall surface 53*a* of the nozzle adapter 50 may face the first lateral inner surface 182*a* of the actuator housing 20, and the second lateral outer sidewall surface 53*b* of the nozzle adapter 50 may face the second lateral inner surface 182*b* of the actuator housing 20. Further, the first transverse outer sidewall surface 53*c* of the nozzle adapter 50 may face the first transverse inner surface 183*a* of the actuator housing 20, and the second transverse outer sidewall surface 53*d* of the nozzle adapter 50 may face the second transverse inner surface 183*b* of the actuator housing 20. The dispensing module 10 may also be configured such that the protrusion top surface 241*a* contacts the actuator housing bottom surface 21*b*. The actuator housing 20 may define apertures 155 that extend into the body 22 of the actuator housing 20 from the actuator housing bottom surface 21*b*. The apertures 155 may extend substantially along the longitudinal direction 14, or may extend along any other direction as desired. When a portion of the nozzle adapter 50 is received within the body cavity 104, the apertures 155 of the actuator housing 20 are configured to align with the apertures 235 defined by the protrusion 240 of the nozzle adapter 50. As a result, the apertures 155 and the apertures 235 are configured to receive the fasteners 55. As noted above, the fasteners 55 may be configured to releasably secure the nozzle adapter 50 to the actuator housing 20. In one embodiment, the fasteners 55 may be configured as threaded screws 60. Any number of fasteners 55 can be used as needed. For example, the dispensing module 10 can include one, two, three, or more fasteners 55 as needed. For each fastener 55 that is included in the dispensing module 10, the actuator housing 20 will have a corresponding number of apertures 155, and the protrusion 240 will have a corresponding number of apertures 235.

The threaded screws 60 may each have a head 61 that can be shaped so as to engage a fastening tool (not shown) in order to insert the threaded screws 60 into the apertures 155 and 235. For example, each head 61 may define a hex shape. Alternatively, each head 61 of the threaded screws 60 may define a socket 63 extending into the head 61. Each socket 63 may be configured to receive a fastening tool (not shown) in order to insert the threaded screws 60 into the apertures 155 and 235. The threaded screws 60 may each also include a threaded shaft 62 extending from the head 61. Likewise, apertures 155 and 235 may be at least partially threaded so as to engage the threaded shaft 62 of each of the threaded screws 60. In addition to the threaded screws 60, the fasteners 55 can be any other type of fastener as desired.

Referring now to FIGS. 6 and 7, the upper portion of the nozzle body 51 of nozzle adapter 50 may define a recess 270 that extends into the nozzle body 51 of the nozzle adapter 50. The recess 270 is configured to receive a flexible seal 230. The flexible seal 230 may be an O-ring, for example, or may be any other type of seal as desired. When a portion of the nozzle adapter 50 is received within the body cavity 104 of the actuator housing 20, the flexible seal 230 may be configured to be seated between the actuator housing 20 and the nozzle adapter 50 in the recess 270 such that the flexible seal 230 also contacts the body cavity top surface 180. The flexible seal 230 can be configured to prevent fluid from escaping the nozzle adapter 50 and leaking into the body cavity 104. The upper portion of the nozzle body 51 of nozzle adapter 50 also includes a seal seat 260 that extends from the upper surface 52*a* of the nozzle adapter 50 towards the lower surface 52*b* of the nozzle adapter 50. The seal seat 260 can be substantially circular, and includes a seal surface 261 that extends from the upper surface 52*a* of the nozzle adapter 50 to a seal ledge 262. The seal ledge 262 may extend in a direction that is substantially perpendicular to the seal surface 261. The seal seat 260 is configured to receive at least one seal 225, and is configured to be open to the fluid channel 250.

Figure 9:
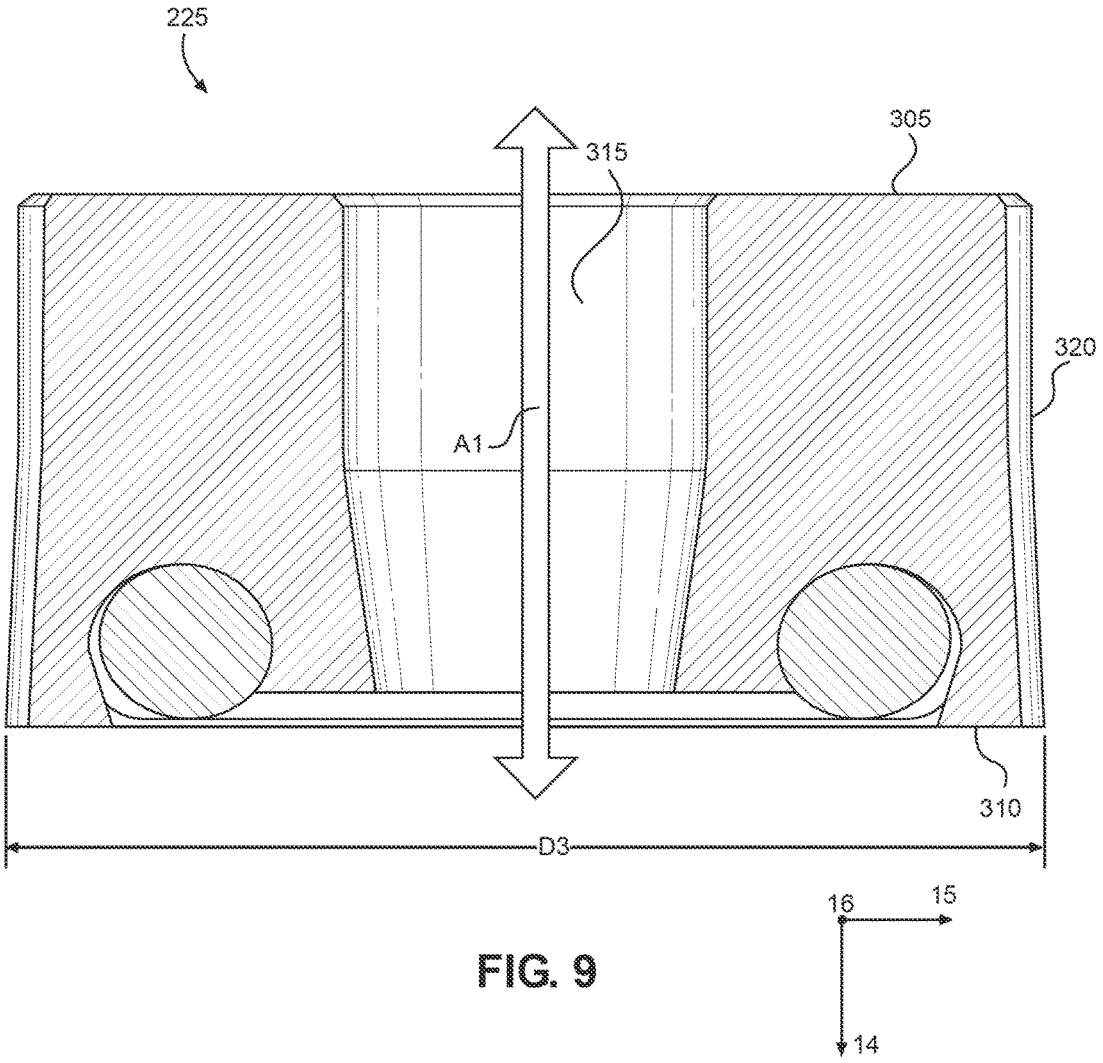
FIG. 9 is a longitudinal cross section of a seal shown in FIGS. 3, 4, and 6.

Referring to FIG. 9, the seal 225 defines a top surface 305 and a bottom surface 310 spaced from the top surface 305 along the longitudinal direction 14. The seal 225 also defines a circular side surface 320 that extends from the top surface 305 to the bottom surface 310. The circular side surface 320 may extend substantially parallel to the longitudinal direction 14, or may be configured otherwise as desired. For example, the circular side surface 320 may taper inward towards the center of the seal 225 from the top surface 305 towards the bottom surface 310. Alternatively, the circular side surface 320 may taper outwards away from the center of the seal 225 from the top surface 305 towards the bottom surface 310. Other types of tapering of the circular side surface 320 are also contemplated. A taper in the circular side surface 320 may aid the seal 225 in forming a tighter fit with the seal seat 260 when the seal 225 is received within the seal seat 260, thus providing a more effective seal against unwanted fluid migration through the seal seat 260. The seal 225 further defines a needle passageway 315 that may be substantially centered within the seal 225, where the needle passageway 315 extends from the top surface 305 to the bottom surface 310 in the longitudinal direction 14 along a central axis $a_1$. The needle passageway 315 is configured to receive a portion of the needle 40 when the seal 225 is received in the seal seat 260 of the nozzle adapter 50. The needle passageway 315 may extend substantially parallel to the longitudinal direction 14. The needle passageway 315 may also taper inward toward the central axis $a_1$ of the seal 225 from the top surface 305 of the seal 225 towards the bottom surface 310. Alternatively, the needle passageway 315 may taper outward towards the circular side surface 320 from the top surface 305 of the seal 225 towards the bottom surface 310. Tapering of the needle passageway 315 may aid the seal 225 in forming a tighter fit with the needle 40 when the needle 40 extends through the needle passageway 315, thus providing a more effective seal against unwanted fluid migration through the needle passageway 315. Additionally, the seal 225 defines an outer diameter $d_3$ that is measured from two opposing points on the circular side surface 320 along a direction that is substantially perpendicular to the central axis $a_1$ of the needle passageway 315.

Referring again to FIGS. 4 and 6-8, the seal 225 may be configured to be received by the seal seat 260 of the nozzle adapter 50, such that a portion of the bottom surface 310 of the seal 225 contacts the seal ledge 262 of the seal seat 260, and the circular side surface 320 of the seal 225 contacts the seal surface 261 of the seal seat 260. When a portion of the nozzle adapter 50 is disposed within the body cavity 104 of the actuator housing 20, the seal 225 may be oriented such that the needle passageway 315 of the seal 225 aligns with the needle passageway 170 of actuator housing 20. Also, the top surface 305 of the seal 225 may contact the body cavity top surface 180. As a result, the needle 40 can extend from the actuator cavity 103, through the needle passageway 170, and through the needle passageway 315 of the seal 225. In another embodiment, the seal seat 260 is configured to receive two of seals 225. Each of the two seals 225 may be substantially identical, or can differ in design as desired. For example, each of the two seals 225 may have equal diameters $d_3$, or can have different diameters $d_3$ as desired. In this embodiment, when both of the seals 225 are disposed within the seal seat 260, the first seal is stacked on top of the second seal, such that the top surface 305 of the first seal 225 may contact the body cavity top surface 180, the bottom surface 310 of the first seal 225 may contact the top surface 305 of the second seal 225, and the bottom surface 310 of the second seal 225 may contact the seal ledge 262 of seal seat 260. Additionally, in this embodiment, the needle passageways 315 of both seals will align such that both of the needle passageways 315 can receive the needle 40. The use of multiple seals 225 can provide additional protection against liquid flowing through seal seat 260 and the needle passageway 170 from the fluid channel 250, which will be discussed in further detail below. Additionally, the use of multiple seals 225 can lengthen the amount of time required before dispensing module 10 must be disassembled and the seals 225 replaced.

The nozzle adapter 50 further defines a fluid channel 250 that extends through the nozzle adapter 50 from the seal seat 260 to the fluid outlet 210. The fluid channel 250 is partially defined by a sidewall 251, and may also be partially defined by a valve seat 255. The sidewall 251 may extend longitudinally from the seal seat 260 to the valve seat 255. In one embodiment, the valve seat 255 is configured as a tapered surface that extends from the sidewall 251 to the fluid outlet 210. However, the valve seat 255 can be configured as a surface with any geometric shape as desired. The fluid channel 250 defines a maximum diameter $d_2$ that extends from one side of the sidewall 251 to the other along a direction that is substantially perpendicular to the longitudinal direction 14. The maximum diameter $d_2$ may be located anywhere along the fluid channel 250 along the longitudinal direction 14. In one embodiment, the sidewall 251 of the fluid channel 250 is substantially straight, and extends substantially perpendicular to the longitudinal direction 14, such that the portion of the fluid channel 250 defined by the sidewall 251 defines a substantially constant diameter $d_2$. However, the sidewall 251 of the fluid channel 250 could take on other embodiments as desired. For example, the sidewall 251 of the fluid channel 250 could be curved, tapered, etc. along the longitudinal direction 14. The fluid channel 250 may define a substantially uniform cross section along the longitudinal direction 14. Alternatively, the cross section of the fluid channel 250 may not be uniform along the longitudinal direction 14. Additionally, the fluid outlet 210 defines a diameter $d_1$ that extends from one side of the fluid outlet 210 to the other along a direction that is substantially perpendicular to the longitudinal direction. The fluid channel 250 may be configured such that the maximum diameter $d_2$ of the fluid channel 250 is greater than the diameter $d_1$ of the fluid outlet 210, but is less than the diameter $d_3$ of the seal 225. Likewise, the diameter $d_1$ of the fluid outlet 210 may be less than the diameter $d_3$ of the seal 225. The fluid channel 250 may also define a relatively small volume. In one embodiment, the volume of the fluid channel 250 is about 0.1 cubic inches. However, the volume of the fluid channel 250 can be any volume as desired as long as the volume is minimalized to maximize fluid velocity for best scavenging while not interfering with max flow requirements of the application.

When the seal 225 is disposed in the seal seat 260 of the nozzle adapter 50, the bottom surface 310 of the seal 225 may partially define the fluid channel 250. In this configuration, the seal 225 prevents fluid from flowing out of the fluid channel 250 and into the needle passageway 170 or the body cavity 104. Alternatively, the seal seat 260 can also receive more than one seal 225, for example two seals 225, for additional protection against fluid migration out of the fluid channel 250. In this configuration, the bottom surface 310 of the bottom seal 225 partially defines the fluid channel 250. The close proximity of the bottom surface 310 of the seal 225, which may be a bottom seal 225 when the seal seat 260 receives more than one seal 225, to the flow of fluid through the fluid channel 250 helps prevent semi-cured fluid from building up on and around the bottom surface 310 of the seal 225.

Figure 8:
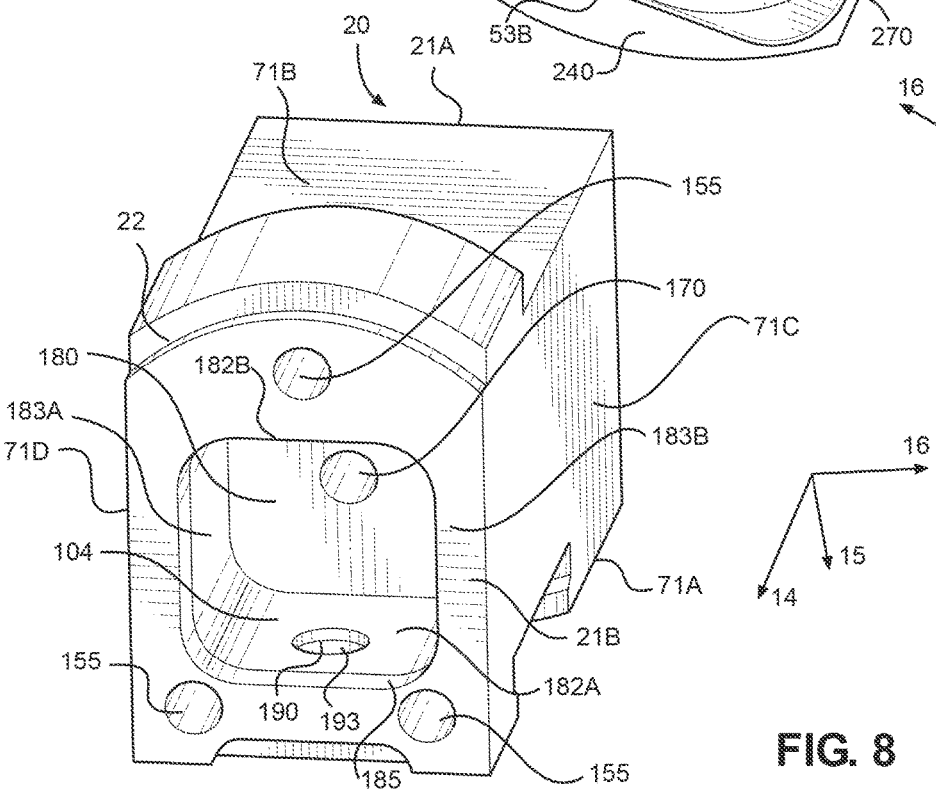
FIG. 8 is a perspective view of the actuator housing shown in FIGS. 1-6.

The fluid channel 250 is aligned with the needle passageway 315 of the seals 225 and the needle passageway 170 of the actuator housing 20, such that the needle 40 extends from an upper end 41 within the actuator cavity 103, through the needle passageway 170 of the actuator housing 20, through the needle passageway 315 of the seals 225, and into fluid channel 250 of the nozzle adapter 50. Needle 40 defines a lower end 42 disposed within the fluid channel 250 that is opposite the upper end 41 along the longitudinal direction 14, such that the needle 40 terminates at the lower end 42 within the fluid channel 250. The needle 40 defines a valve element 45 at the lower end 42, which is configured to interact with the valve seat 255, as will be described below in further detail. The valve element 45 could be any type of valve element as desired. In one embodiment, the valve element 45 is a ball valve element 46. Alternatively, the valve element 45 could be a needle valve element. The fluid channel 250 is configured such that it is completely spaced along the lateral direction 15 and/or the transverse direction 16 from each of the apertures 235 of the protrusion 240. The fluid channel 250 is also configured such that it is completely spaced along the lateral direction 15 and/or the transverse direction 16 from each of the apertures 155 of the actuator housing 20. As such, none of the apertures 155 and the apertures 235 is open to the fluid channel 250. Thus, when the fasteners 55 are inserted through the apertures 155 of the nozzle adapter 50 and the apertures 235 of the protrusion 240, they do not enter the fluid channel 250 or interfere with the flow of fluid through the fluid channel 250. In one embodiment, as shown in FIGS. 6-8, the apertures 155 and 235 are completely spaced from the fluid channel 250 along the lateral direction 15. The apertures 155 and 235 can be seen as extending generally parallel to the fluid channel 250 along the longitudinal direction 14.

With continued reference to FIGS. 4 and 6-8, the actuator housing 20 defines an actuator fluid inlet 193 that extends from the outer surface 70 of the actuator housing 20 to the body cavity 104. In one embodiment, the actuator fluid inlet 193 extends from the first lateral outer surface 71*a* through the body 22 of the actuator housing 20 to the first lateral inner surface 182*a*, such that the actuator fluid inlet 193 is open to the body cavity 104. However, it is envisioned that the actuator fluid inlet 193 could extend from anywhere along the outer surface 70 through the body 22 of the actuator housing 20 to the body cavity 104. For example, the actuator fluid inlet 193 could extend from the first lateral outer surface 71*a*, the second lateral outer surface 71*b*, the first transverse outer surface 71*c*, or the second transverse outer surface 71*d*. The actuator fluid inlet 193 is configured to receive a flow of fluid from an external source (not shown). The actuator housing 20 may define an actuator fluid inlet groove 196 that extends into the body 22 of the actuator housing 20. The actuator fluid inlet groove 196 may be disposed around an outer opening of the actuator fluid inlet 193, the actuator fluid inlet groove 196 being configured to receive a flexible seal 215, such as an O-ring. The flexible seal 215, when disposed within the actuator fluid inlet groove 196, engages with both the actuator housing 20 and an external source of fluid flow (not shown), such that fluid does not leak out of the actuator fluid inlet 193.

The nozzle adapter 50 defines a fluid inlet 245 that extends from the outer sidewall surface 53 of the nozzle adapter 50 to the sidewall 251 of the fluid channel 250. As shown in FIG. 6, in one embodiment the fluid inlet 245 extends from the first lateral outer surface 71*a* through the nozzle body 51 of the nozzle adapter 50 to the sidewall 251 of the fluid channel 250. However, it is envisioned that the fluid inlet 245 may extend from anywhere along the outer sidewall surface 53 of the nozzle adapter 50 through the nozzle body 51 of the nozzle adapter 50 to the sidewall 251 of the fluid channel 250. For example, the fluid inlet 245 could extend from the first lateral outer sidewall surface 53*a*, the second lateral outer sidewall surface 53*b*, the first transverse outer sidewall surface 53*c*, or the second transverse outer sidewall surface 53*d*. The fluid inlet 245 may be disposed such that the fluid inlet 245 defines an opening 246 at the fluid channel 250 that is between the seal seat 260 and the fluid outlet 210 along the longitudinal direction 14. The fluid inlet 245 is configured to be in fluid communication with both the actuator fluid inlet 193 and the fluid channel 250, such that fluid entering the dispensing module 10 flows through the actuator fluid inlet 193, through the fluid inlet 245, and into the fluid channel 250. From there, fluid flows through the fluid channel 250 and out the fluid outlet 210. As such, dispensing module 10 defines a fluid flow path 252 that includes the actuator fluid inlet 193, fluid inlet 245, fluid channel 250, and fluid outlet 210, wherein all parts of the fluid flow path 252 are in fluid communication with each other.

In an embodiment, the first lateral inner surface 182*a* of the actuator housing 20 may define a groove 190 that extends into the body 22 of the actuator housing 20. The groove 190 may extend around an opening of the actuator fluid inlet 193. Additionally, the first lateral outer sidewall surface 53*a* of the nozzle adapter 50 may define a recess 265 that extends into the nozzle body 51 of the nozzle adapter 50. The recess 265 may extend around an opening of the fluid inlet 245. The groove 190 and recess 265 may be configured to receive a flexible nozzle inlet seal 220, such that when the dispensing module 10 is fully assembled, the flexible nozzle inlet seal 220 is disposed between the first lateral outer sidewall surface 53*a* of the nozzle adapter 50 and the first lateral inner surface 182*a* of the actuator housing 20. The flexible nozzle inlet seal 220 is configured to prevent fluid from leaking between the actuator housing 20 and the nozzle adapter 50 as the fluid flows from the actuator fluid inlet 193 to the fluid inlet 245. The flexible nozzle inlet seal 220 may be any type of seal, such as an O-ring, for example. Groove 190 and recess 265 are not limited to the first lateral outer sidewall surface 53*a* and the first lateral inner surface 182*a*, respectively. The groove 190 may be defined by any of the inner surfaces 182*a*, 182*b*, 183*a*, or 183*b*, and the recess 265 may be defined by any part of the outer sidewall surface 53. Generally, though, the groove 190 will be disposed around an opening of the actuator fluid inlet 193, and the recess 265 will extend around an opening of the fluid inlet 245. The groove 190 and recess 265 function to help prevent damage to the flexible nozzle inlet seal 220 when the nozzle adapter 50 and the flexible nozzle inlet seal 220 are inserted into the actuator cavity 103 during assembly of the dispensing module 10.

The actuator housing 20 may define a beveled edge 185 that extends from the actuator housing bottom surface 21*b* to the first lateral inner surface 182*a*. However, the beveled edge 185 may also extend around the opening to the body cavity 104, such that the beveled edge 185 also extends from the actuator housing bottom surface 21*b* to the first transverse inner surface 183*a*, from the actuator housing bottom surface 21*b* to the second transverse inner surface 183*b*, and/or from the actuator housing bottom surface 21*b* to the second lateral inner surface 182*b*. The sloped profile of the beveled edge 185 aids in assembly of the dispensing module 10. When the nozzle adapter 50 is inserted into the body cavity 104, the flexible nozzle inlet seal 220 must simultaneously be inserted into the body cavity 104 in order for the flexible nozzle inlet seal 220 to be seated in both the recess 265 of the nozzle adapter 50 and the groove 190 of the actuator housing 20. The beveled edge 185 allows for a gradual transition of the flexible nozzle inlet seal 220 into the body cavity 104 to increase ease of assembly of the dispensing module 10.

In operation, the dispensing module 10 receives fluid from an external source (now shown) through the actuator fluid inlet 193. The fluid then flows along the fluid flow path 252 through the actuator fluid inlet 193, through the fluid inlet 245, and into the fluid channel 250. Initially, the needle 40 is in a first position, such that the valve element 45 contacts the valve seat 255, preventing fluid from flowing out of the fluid outlet 210. When a user of the dispensing module 10 desires to dispense fluid from the dispensing module 10, the user actuates the actuator 109. In one embodiment, when the actuator 109 is actuated, pressurized air is pumped into the lower portion 103*b* of the actuator cavity 103 through the air inlet 149. The pressurized air in the lower portion 103*b* of the actuator cavity 103 exerts a force on the lower piston element 125, which moves the piston assembly 114 upwards. Because the upper end 41 of the needle 40 is coupled to the piston assembly 114, the needle 40 will also move upwards. As a result, the lower end 42 and valve element 45 of the needle 40 will move upwards into a second position and become spaced away from the valve seat 255, thus allowing fluid to flow through the fluid outlet 210. In one embodiment, a continuous flow of fluid flows through the fluid outlet 210 due to internal pressure created by the fluid disposed within the fluid channel 250. In another embodiment, a discrete amount of fluid is dispensed from the fluid outlet 210 due to pressure created from pressurized air.

During operation, when the user wants to stop fluid from flowing through the fluid outlet 210, the user must return the needle 40 to the first position, such that the valve element 45 of the needle 40 contacts the valve seat 255, blocking the fluid outlet 210. To do this, in one embodiment, the user ceases actuation of the actuator 109, which depressurizes the lower portion 103*b* of the actuator cavity 103. As a result, the spring 110, which is operatively coupled to the piston assembly 114, urges the piston assembly 114 and the needle 40 downwards until the needle 40 is in the first position. Alternatively, pressurized air is pumped into upper portion 103*a* of the actuator cavity 103 through the second air inlet 144. Once pressure in the upper portion 103*a* of the actuator cavity 103 becomes greater than the pressure in the lower portion 103*b* of the actuator cavity 103, the piston assembly 114 and the needle 40 are urged downwards until the needle 40 is in the first position. The needle 40 can be alternated between the first position and the second position as many times as needed during the operation of the dispensing module 10.

During the course of operating the dispensing module 10, a user may be forced to cease operation of the dispensing module 10 for several reasons. For instance, even though the fluid channel 250 is shaped so as to reduce fluid build-up during operation of the dispensing module 10, fluid flowing through the dispensing module 10 can still partially cure and build up within the fluid flow path 252. Over time, this semi-cured fluid build-up can affect the flow of fluid through the fluid flow path 252 and hinder the overall operation of the dispensing module 10. Because of this, the dispensing module 10 must be disassembled, and all elements of the fluid flow path 252 through which fluid flows (i.e., the actuator fluid inlet 193, fluid inlet 245, fluid channel 250, and fluid outlet 210) must be purged of semi-cured fluid build-up. Disassembly of the dispensing module 10 can be easily accomplished by first removing the fasteners 55 from the apertures 155 and 235 using a fastening tool (not shown). Then, the nozzle adapter 50 can slide out of the body cavity 104 of the actuator housing 20. When the actuator housing 20 and the nozzle adapter 50 are separated, the actuator fluid inlet 193, fluid inlet 245, fluid channel 250, and fluid outlet 210 can be flushed using a flush material. Preferably, the flush material is a compatible material having a similar viscosity to the fluid that has built up within the dispensing module 10, though any flush material can be used as desired. The fluid flow path 252 defined by dispensing module 10, as well as the relatively low volume of the fluid channel 250, allows for a comparatively simple and quick flushing process. The low volume of the fluid channel 250 also maximizes fluid velocity within the nozzle adapter 50, which assists in removing semi-cured fluid from the nozzle adapter 50 during operation of the dispensing module 10, without interfering with flow requirements of an application of the dispensing module 10. Additionally, the simple geometry of the fluid channel 250 allows for easy verification that all of the semi-cured fluid, as well as the flush material, has been flushed out of the dispensing module 10, such that any fluid that will subsequently pass through the dispensing module 10 does not become contaminated by any remaining fluid or flush material.

Another instance that can require a user to cease operation of the dispensing module is the leakage of fluid outside the fluid flow path 252. The dispensing module 10 may include several different seals that act as safeguards against the leakage of fluid out of the fluid flow path 252, as discussed above. For example, the dispensing module 10 may include the actuator inlet seal 215, which may engage with both the actuator housing 20 and an external source of fluid flow (not shown), such that fluid does not leak out of the actuator fluid inlet 193. The dispensing module 10 may also include the flexible nozzle inlet seal 220 disposed between the first lateral outer sidewall surface 53*a* of the nozzle adapter 50 and the first lateral inner surface 182*a* of the actuator housing 20, which is configured to prevent fluid from leaking between the actuator housing 20 and the nozzle adapter 50 as the fluid flows from the actuator fluid inlet 193 to the fluid inlet 245. The dispensing module 10 also includes at least one seal 225 disposed within the seal seat 260 of the nozzle adapter 50 that is configured to prevent fluid from flowing out of the fluid channel 250 and into the needle passageway 170 or the body cavity 104. In another embodiment, the dispensing module 10 can include two of seals 225 disposed within the seal seat 260. The dispensing module may also include the flexible seal 230 that is configured to be seated in the recess 265 of the nozzle adapter 50, such that the flexible seal 230 also contacts the body cavity top surface 180. The flexible seal 230 can be configured to prevent fluid from escaping the nozzle adapter 50 and leaking into the body cavity 104. As the dispensing module 10 continues to be used over time, any of the seals listed above (e.g., the actuator inlet seal 215, flexible nozzle inlet seal 220, seals 225, and flexible seal 230) may become worn and begin to leak, or ultimately completely fail. In such a circumstance, a user of the dispensing module 10 must cease operation of the dispensing module 10 and replace the failed seal or seals. The dispensing module 10 can be easily disassembled, as noted above. As all of the seals are located on the exterior of the nozzle adapter 50 or actuator housing 20, and particularly not within the fluid flow path 252, the seals can be easily and quickly replaced upon disassembly of the dispensing module 10. This limits the difficulty of replacing the seals, and keeps the time that the dispensing module 10 is inoperable to a minimum.

The present disclosure is described herein using a limited number of embodiments. These specific embodiments are not intended to limit the scope of the disclosure as otherwise described and claimed herein. Modification and variations from the described embodiments exist. More specifically, the examples included are given as a specific illustration of embodiments of the claimed disclosure. It should be understood that the invention is not limited to the specific details set forth in the examples, and that various changes, substitutions, and alterations can be made without departing form the spirit and scope of the invention as defined by the appended claims.

What is claimed is:

1. A dispensing module for dispensing a liquid, the dispensing module comprising:

an actuator housing defining an actuator cavity, a body cavity, and a needle passageway connecting the actuator cavity and the body cavity;

an actuator disposed within the actuator cavity;

a needle defining an upper end and a lower end opposite the upper end in a longitudinal direction, the lower end defining a valve element, wherein the upper end of the needle is secured to the actuator such that the needle extends from the actuator cavity through the needle passageway;

a nozzle adapter releasably coupled to the actuator housing, the nozzle adapter defining a nozzle body including an upper surface, a seal seat extending into the nozzle body from the upper surface, a recess configured to receive a flexible seal, the recess extending into the nozzle body from the upper surface and encircling the seal seat, a fluid inlet, a fluid channel partially defined by a valve seat, and a fluid outlet in fluid communication with the fluid inlet and the fluid channel, the fluid channel extending from the seal seat to the fluid outlet, wherein the nozzle adapter is configured to be at least partially disposed within the body cavity when coupled to the actuator housing, such that the lower end of the needle extends into the fluid channel, and wherein the recess and the seal seat define respective upper openings at the upper surface that are aligned along a direction perpendicular to the longitudinal direction; and at least one seal configured to be received within the seal seat, wherein the at least one seal is configured to prevent flow of the liquid from the fluid channel of the nozzle adapter into the needle passageway of the actuator housing.

2. The dispensing module of claim 1, wherein the body cavity is defined by a top surface, a first transverse inner surface, a second transverse inner surface opposite the first transverse inner surface along a transverse direction that is perpendicular to the longitudinal direction, a first lateral inner surface, and a second lateral inner surface opposite the first lateral inner surface along a lateral direction that is perpendicular to the transverse direction.

3. The dispensing module of claim 2, wherein the at least one seal includes a first seal and a second seal.

4. The dispensing module of claim 3, wherein the first seal is stacked on top of the second seal to collectively define top and bottom surfaces, the top surface of the first seal is configured to contact the top surface of the body cavity, and the bottom surface of the second seal at least partially defines the fluid channel when the first and second seals are received within the seal seat.

5. The dispensing module of claim 4, wherein the first seal and the second seal define respective outer diameters measured at the bottom surface of the seal along the direction that is perpendicular to the longitudinal direction, and the fluid channel defines a maximum diameter measured along the direction, wherein the maximum diameter of the fluid channel is less than the outer diameter of the first seal and the outer diameter of the second seal.

6. The dispensing module of claim 5, wherein the outer diameter of the first seal and the outer diameter of the second seal are substantially equal.

7. The dispensing module of claim 3, wherein the first and second seals each define respective needle passageways configured to receive a portion of the needle.

8. The dispensing module of claim 1, wherein the fluid channel defines a sidewall that extends longitudinally from the seal seat to the valve seat.

9. The dispensing module of claim 1, wherein the fluid outlet defines a diameter along the direction that is perpendicular to the longitudinal direction, and the fluid channel defines a maximum diameter measured along the direction, wherein the diameter of the fluid outlet is less than the maximum diameter of the fluid channel.

10. The dispensing module of claim 1, wherein the valve element is a ball valve element.

11. The dispensing module of claim 1, wherein the fluid channel defines a volume that is about 0.1 cubic inches.

12. The dispensing module of claim 1, wherein the actuator is a pneumatic actuator configured to be in communication with a pressurized air source.

13. The dispensing module of claim 1, wherein the actuator is configured to transition the needle from a first position, where the valve element contacts the valve seat such that the valve element prevents fluid flow through the fluid outlet, to a second position, where the valve element is spaced from the valve seat.

14. The dispensing module of claim 13, wherein the liquid is under internal pressure in the fluid channel as the liquid flows from the fluid inlet of the nozzle adapter to the fluid channel, such that the liquid flows through the fluid outlet of the nozzle adapter when the needle is in the second position.

15. The dispensing module of claim 1, wherein the nozzle body includes a lower surface opposite the upper surface in the longitudinal direction and a protrusion extending from the nozzle body in a lateral direction that is perpendicular to the longitudinal direction at a location between the upper surface and the lower surface along the longitudinal direction.

16. The dispensing module of claim 15, wherein the flexible seal is an O-ring.

17. The dispensing module of claim 15, wherein the actuator housing further defines a top surface and a bottom surface opposite the top surface in the longitudinal direction, the bottom surface defining a first aperture configured to receive a fastener, and the protrusion defines a second aperture configured to receive the fastener, such that the fastener is configured to extend through the first aperture and the second aperture such that the fastener releasably secures the nozzle adapter to the actuator housing.

18. The dispensing module of claim 1, wherein the fluid inlet defines an opening at the fluid channel, the opening being between the seal seat and the fluid outlet along the longitudinal direction.

19. A dispensing module for dispensing a liquid, the dispensing module comprising:

an actuator housing defining a top surface, a bottom surface opposite the top surface in a longitudinal direction, the bottom surface defining a first aperture configured to receive a fastener, the actuator housing further defining an actuator cavity, a body cavity, and a needle passageway connecting the actuator cavity and the body cavity;

an actuator disposed within the actuator cavity;

a needle defining an upper end and a lower end opposite the upper end in the longitudinal direction, the lower end defining a valve element, wherein the upper end of the needle is secured to the actuator such that the needle extends from the actuator cavity through the needle passageway; and a nozzle adapter defining a nozzle body that includes an upper surface, a lower surface opposite the upper surface in the longitudinal direction, and a protrusion extending from the nozzle body in a lateral direction that is perpendicular to the longitudinal direction at a location between the upper surface and the lower surface along the longitudinal direction, the protrusion defining a second aperture configured to receive the fastener, the nozzle adapter further defining a seal seat extending into the nozzle body from the upper surface, a recess configured to receive a flexible seal, the recess extending into the nozzle body from the upper surface and encircling the seal seat, a fluid inlet, a fluid outlet, and a fluid channel extending from the seal seat to the fluid outlet, and wherein the recess and the seal seat define respective upper openings at the upper surface that are aligned along the lateral direction, wherein the fluid channel is in fluid communication with the fluid inlet and the fluid outlet, the fluid channel being partially defined by a valve seat, wherein the nozzle adapter is configured to be at least partially disposed within the body cavity when coupled to the actuator housing, such that the lower end of the needle extends into the fluid channel, and the fastener extends through the first aperture and the second aperture such that the fastener releasably secures the nozzle adapter to the actuator housing.

20. The dispensing module of claim 19, further comprising at least one seal configured to be received within the seal seat of the nozzle adapter, wherein the at least one seal is configured to prevent flow of the liquid from the fluid channel of the nozzle adapter into the needle passageway of the actuator housing.

21. The dispensing module of claim 19, wherein the fastener is a first fastener, the dispensing module further defines:

a second fastener configured to extend through a third aperture defined by the protrusion of the nozzle adapter and a fourth aperture defined by the bottom surface of the actuator housing; and a third fastener configured to extend through a fifth aperture defined by the protrusion of the nozzle adapter and a sixth aperture defined by the bottom surface of the actuator housing, wherein the second and third fasteners are configured to releasably secure the nozzle adapter to the actuator housing.

22. The dispensing module of claim 19, wherein an entirety of the first aperture is spaced from the fluid channel in the lateral direction.

23. The dispensing module of claim 19, wherein the first and second apertures are each at least partially threaded, and the fastener is a screw defining a head and a threaded shaft, such that the threaded shaft is configured to threadedly engage the first and second apertures.

24. The dispensing module of claim 19, wherein the actuator is configured to transition the needle from a first position, where the valve element contacts the valve seat such that the valve element prevents fluid flow through the fluid outlet, to a second position, where the valve element is spaced from the valve seat.

25. The dispensing module of claim 1, wherein the actuator housing defines a monolithic actuator body that defines the actuator cavity, the body cavity, and the needle passageway.

26. The dispensing module of claim 1, wherein the nozzle body is monolithic.

27. The dispensing module of claim 19, wherein the actuator housing defines a monolithic actuator body that defines the actuator cavity, the body cavity, and the needle passageway.

28. The dispensing module of claim 19, wherein the nozzle body is monolithic.

* * * * *